United States Patent [19]

Clouse et al.

[11] 4,100,100

[45] Jul. 11, 1978

[54] COBALT-CONTAINING INHIBITOR FOR SOUR GAS CONDITIONING SOLUTIONS

[75] Inventors: Robert C. Clouse; Robert G. Asperger, both of Midland, Mich.

[73] Assignee: The Dow Chemical Company, Midland, Mich.

[21] Appl. No.: 782,253

[22] Filed: Mar. 28, 1977

[51] Int. Cl.[2] ..... C23F 11/18; B01D 47/02; B01D 53/34

[52] U.S. Cl. ..... 252/189; 252/387; 252/389 R; 423/228; 423/229

[58] Field of Search ..... 252/189, 387, 389 R, 252/192, 392; 423/228, 229; 21/2.5 R, 2.7 R

[56] References Cited

U.S. PATENT DOCUMENTS

| | | | |
|---|---|---|---|
| 2,776,870 | 1/1957 | Fischer | 423/228 |
| 2,869,978 | 1/1959 | Fischer | 423/228 |
| 3,808,140 | 4/1974 | Mago et al. | 252/389 R |
| 3,896,044 | 7/1975 | Mago et al. | 252/392 |
| 3,959,170 | 5/1976 | Mago et al. | 252/189 |

*Primary Examiner*—Benjamin R. Padgett
*Assistant Examiner*—Irwin Gluck
*Attorney, Agent, or Firm*—Glwynn R. Baker

[57] ABSTRACT

The corrosion of iron and steel by an aqueous sour gas conditioning solution used to remove $CO_2$ from a gas stream is effectively inhibited by a combination of a quaternary pyridinium salt and an organic thioamide or water-soluble thiocyanate. The addition of a small amount of a water-soluble cobalt salt to the inhibitor combination improves its effectiveness.

10 Claims, No Drawings

COBALT-CONTAINING INHIBITOR FOR SOUR GAS CONDITIONING SOLUTIONS

BACKGROUND OF THE INVENTION

The present invention relates to a new inhibitor composition useful for preventing corrosion by solvents used in treating sour gas streams and to the inhibited solvent.

The conditioning of naturally occurring and synthetic gases by absorbing acidic gases such as $CO_2$, $H_2S$, COS, and HCN in an absorbent solution has been practiced commercially for many years. Gases such as feed gas for an ammonia plant, natural gas, and flue gas are examples. Aqueous solutions of various compounds such as alkanolamines, sulfolane (tetrahydrothiophene-1,1-dioxide), potassium carbonate, and mixtures of two or more of these have been used for the purpose. The water may be replaced in part or in whole by a glycol. All of these systems are plagued by corrosion of metal equipment which can be caused by products of degradation of the absorbent, by acidic components, or by products of reaction of these acidic components with the absorbent. For example, although aqueous alkanolamine itself is not particularly corrosive toward iron and steel equipment, it becomes highly corrosive when there is dissolved $CO_2$ present, particularly when it is hot. To combat this problem, various metal compounds have been used alone or in combination with other compounds as corrosion inhibitors, for example, compounds of arsenic, antimony, and vanadium. While such metal compounds are effective corrosion inhibitors, they have the disadvantages of low solubility in most gas conditioning solutions and of relatively high toxicity. The latter property is particularly undesirable since it affects both the handling of the solvent and the disposal of waste material.

An organic inhibitor system for inhibiting corrosion of ferrous metals by solutions used in sour gas conditioning which comprises the combination of a quaternary pyridinium salt and a thio compound which is a water-soluble sulfide, thiocyanate, or an organic thioamide in a weight proportion of one part of pyridinium salt to about 0.001–10 parts of thio compound is described in our concurrently filed application Ser. No. 782,156 entitled Inhibitor for Gas Conditioning Solution. The inhibitor combination is preferably added to the solution in a total concentration of about 50–2000 ppm.

SUMMARY OF THE INVENTION

It has now been found that the efficiency of the quaternary pyridinium slat-thioamide or thiocyanate inhibitor combination is improved by the addition thereto of a small but effective quantity of a water-soluble cobaltous compound, preferably about 5–1,000 ppm as cobalt based on the weight of aqueous alkanolamine solution although any significant concentration of cobaltous ion contributes some improved inhibiting efficiency.

DETAILED DESCRIPTION

Essentially any cobaltous compound which is sufficiently soluble in the aqueous alkanolamine solution to provide the desired concentration of cobaltous ions can be used. Salts such as $CoCl_2$, $CoBr_2$, $CoSO_4$, $Co(NO_3)_2$, cobaltous acetate and cobaltous benzoate are all suitable sources of cobaltous ions. Salts such as the acetate, benzoate, or bromide are particularly preferred. Preferably, such salts are added to the alkanolamine solution in a concentration to provide about 10–50 parts per million of divalent cobalt.

In the basic quaternary salt-thioamide or thiocyanate inhibitor system, essentially any pyridinium salt which is stable in aqueous alkanolamine is operable. Preferably, this salt has the formula:

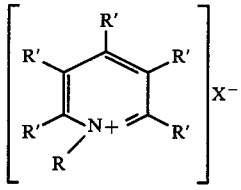

where R is an alkyl radical of 1–20 carbon atoms, a benzyl radical, or an alkylated benzyl radical wherein the aromatic ring has one or more alkyl substituents totaling 1–20 carbon atoms, each R′ is a hydrogen atom or an alkyl radical of 1–6 carbon atoms, and X is any convenient anionic radical such as halide, sulfate, acetate, or nitrate. In the above general formula, X is preferably a bromine or chlorine atom and most preferably bromine. Best results are also obtained when at least one R′ represents an alkyl radical and particularly good inhibition has been found when the pyridine ring has multiple alkyl substituents. Preferably, R is a higher alkyl radical of about 10–18 carbon atoms.

The thio compound in the inhibitor combination is preferably a water-soluble thiocyanate such as an alkali metal thiocyanate or most preferably, ammonium thiocyanate. It can also be an organic thioamide and essentially any such compound is operable. This class of compounds includes thiourea, a polythiourea, a hydrocarbon substituted derivative thereof, or a thioamide having the formula:

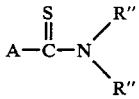

wherein A is a hydrocarbon radical of 1–12 carbon atoms or a pyridyl radical and each R″ is a hydrogen atom or an alkyl radical of 1–8 carbon atoms. Thioamides such as thiourea, 1,2-diethylthiourea, propylthiourea, 1,1-diphenylthiourea, thiocarbanilide, 1,2-dibutylthiourea, dithiobiurea, thioacetamide, thionicotinamide, and thiobenzamide are representative of this class.

A soluble sulfide is not an appropriate thio compound in the inhibitor combination in the presence of cobalt since the latter is thereby precipitated.

While any significant quantity of the inhibitor combination will provide some degree of inhibition of corrosion, at least about 60 parts per million concentration of the three-component combination in the gas conditioning solution is usually required to provide practical protection. The cobalt compound, the thio compound or the pyridinium salt alone will provide no inhibition or only partial inhibition. It appears that very little of the thio compound is usually needed in the basic thio compound-pyridinium salt combination, however, concentrations as low as one part per million of thio compound in the presence of 50–100 parts per million of pyridinium salt having been found to give effective inhibition in some cases. About the maximum degree of inhibition obtainable with a particular combination is usually found when the concentration of the thio compound reaches a concentration of 10–100 parts per million. Higher concentrations of this component appear to offer little or no added benefit under most conditions but may help when the quaternary salt concentration is at a much higher level.

On the other hand, it has been found that at least about 50 parts per million and preferably 100–1000 parts of the pyridinium salt is required to obtain optimum results. For each combination, a maximum degree of inhibition seems to occur at a particular level within the preferred ranges described above and higher concentrations of either component or of the combined components provide slight added protection, if any. In many cases, higher concentrations seem to cause a slight decline in the degree of inhibition after a maximum has been reached.

The present invention affords effective inhibition of iron and steel corrosion by sour gas conditioning solutions containing dissolved $CO_2$ using relatively low concentrations of an inhibitor combination which is easily handled and convenient to use. The added cobalt component is relatively nontoxic and makes it possible to use less of the pyridinium quaternary salt. A concentrate of the combined compounds can be made up in aqueous alkanolamine alcohol, or aqueous glycol and this concentrate can be added to the gas treating solvent as required to make up or to maintain a desired concentration.

This inhibitor combination is particularly useful in aqueous lower alkanolamine solutions known as sour gas scrubbing solvents. Preferred lower alkanolamines can be defined as those having the formula:

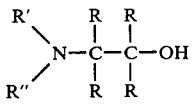

wherein R′ and R″ independently represent hydrogen or $—CR_2CR_2—OH$ and wherein each R may be hydrogen or an alkyl radical of 1–2 carbon atoms. Representative alkanolamines are ethanolamine, diethanolamine, triethanolamine, isopropanolamine, diisopropanolamine, and N-methyldiethanolamine. Related alkanolamines which are useful acidic gas absorbents are Methicol (3-dimethylamino-1,2-propanediol) and diglycolamine (2-(2-aminoethoxy)ethanol). Other gas-treating absorbents in which this inhibitor combination is effective include sulfolane (tetrahydrothiophene-1,1-dioxide) and aqueous potassium carbonate. These absorbents can be employed alone or in combinations of two or more, usually in aqueous solution although the water may be replaced in part or wholly by a glycol.

TESTING PROCEDURE

The corrosion of mild steel by aqueous alkanolamine solutions saturated with $CO_2$ for 7 hours at 10°–20° C was measured at elevated temperatures and moderate pressure. Loosely capped bottles each containing 120 ml of test solution and a totally immersed 1 × 2.5 × 0.0625 inch coupon of 1020 mild steel were put in a modified pressure filter for a period of 16–18 hours, at 125° C and 40 psig unless otherwise specified. The test solution was 30% aqueous ethanolamine unless otherwise specified. The steel coupons were previously cleaned with 5N HCl by immersion for 30 minutes at room temperature followed by a soap and water wash, a water rinse, then an acetone rinse and air drying. At least two bottles of each trial solution were tested in each experiment along with three bottles of solution containing no inhibitor which served as controls. After testing, the same cleaning procedure was used except that the HCl treatment was 15 minutes with 5N HCl inhibited with Dowell A-120, a commercial inhibitor (Dowell Division, The Dow Chemical Company), in order to remove any corrosion deposits. The corrosion rate and efficiency of inhibition were calculated according to the following formulas using the average weight loss of the test coupons:

$$\text{Rate (mils/yr)} = \frac{534 \times \text{mgs weight loss of coupon}}{(\text{coupon density, g/cc})\,(\text{coupon surface, sq in})\,(\text{hrs})}$$

$$\%\ \text{Inhibition} = \frac{\text{Corrosion rate of blanks} - \text{rate of test coupons}}{\text{corrosion rate of blanks}} \times 100$$

PREPARATION OF QUATERNARY SALTS

The quaternary pyridinium salts used in the inhibitor compositions were made by heating a mixture of the pyridine compound with excess alkyl halide or benzyl halide at 90° C for 2 hours. The reaction mixture was then cooled and the quaternary salt was recovered as a solid or viscous liquid precipitate.

EXAMPLE 1

The alkylpyridinium quaternary salt used in these tests was the reaction product of dodecylbenzyl chloride and high boiling alkylpyridine still bottoms (HAP) sold by Reilly Tar and Chemical Corp. These still bottoms were from processes for making various lower alkylpyridines wherein most of the components were pyridines having multiple lower alkyl substituents, particularly methyl and ethyl groups.

Other pyridinium salts referred to in following examples as "alkylpyridinium" salts were also made from HAP as described.

The following inhibition tests were run in 15% aqueous ethanolamine. The organic part of the inhibitor combination was added as a solution of 3 ml of the crude quaternary salt and 1.25 g of thiourea in a mixture of 3.5 ml of water and 4.5 ml of ethylene glycol.

| Concentration, ppm | | |
|---|---|---|
| Organic Formulatin | Co Acetate | % Inhibition |
| 100 | — | 70.7 |
| 2000 | — | 82.1 |
| — | 100 | 58.1 |
| 100 | 100 | 93.1 |
| 2000 | 100 | 92.0 |

EXAMPLE 2

The procedure of Example 1 was repeated using 30% aqueous ethanolamine.

| Concentration, ppm | | |
|---|---|---|
| Organic Formulation | Co Acetate | % Inhibition |
| 100 | — | 21.0 |
| 2000 | — | 63.5 |
| — | 100 | 43.7 |
| 100 | 100 | 95.9 |

-continued

| Concentration, ppm | | |
|---|---|---|
| Organic Formulation | Co Acetate | % Inhibition |
| 2000 | 100 | 98.9 |

EXAMPLE 3

In these tests, tetradecyl alkylpyridinium bromide and thioacetamide were added separately to 20% aqueous ethanolamine as organic inhibitor components.

| Concentration, ppm | | | |
|---|---|---|---|
| Quat. Salt | Thioacetamide | Co Acetate | % Inhibition |
| 500 | 25 | — | 88.2 |
| 1000 | 25 | — | 88.5 |
| 500 | 25 | 100 | 95.2 |
| 500 | 50 | 50 | 97.2 |

EXAMPLE 4

The following tests were run in 30% aqueous ethanolamine with the organic inhibitor components added separately as in Example 3.

| Quat. | Concentration, ppm | | | |
|---|---|---|---|---|
| Salt | Quat. Salt | Thioacetamide | Co Acetate | % Inhibition |
| A | 100 | 25 | — | 87.6 |
| | 100 | 25 | 100 | 95.1 |
| | 100 | 25 | 50 | 96.0 |
| B | 100 | 50 | — | 63.1 |
| | 1000 | 50 | — | 88.7 |
| | 100 | 50 | 50 | 86.0 |
| | 1000 | 50 | 100 | 90.4 |
| A | 100 | 50* | — | 90.5 |
| | 100 | 50* | 100 | 92.8 |

*Thio compound was thioisonicotinamide
A = Tetradecyl alkylpyridinium bromide
B = Tetradecyl 3-methylyridinium bromide

EXAMPLE 5

The procedure of Example 4 was repeated except for using $NH_4SCN$ as the thio compound. The quaternary pyridinium salt was tetradecyl alkylpyridinium bromide.

| Concentration, ppm | | | |
|---|---|---|---|
| Quat. Salt | $NH_4SCN$ | Co Acetate | % Inhibition |
| 100 | 25 | 50 | 92.5 |
| 100 | 25 | 100 | 92.1 |

No added protection was found when the concentration of the cobaltous acetate was doubled.

Similar results are obtained when the procedures of the above examples are repeated using equivalent concentrations of cobalt compounds such as cobaltous chloride, cobaltous bromide, cobaltous sulfate, or cobaltous benzoate in place of the cobaltous acetate shown. In the same way, thio compounds such as sodium thiocyanate, thiobenzamide, dithiobiurea and pyridinium salts such as benzylpyridinium bromide, decyltrimethylpyridinium bromide, ethylbenzylethylpyridinium sulfate, and octadecyl alkylated pyridinium chloride can be used in equivalent amounts in place of the thio compounds and pyridinium salts shown in these examples to obtain comparable corrosion inhibition.

Similarly, these inhibitor combinations are effective to prevent corrosion of ferrous metals by other sour gas conditioning solutions such as previously described. For example, aqueous or glycol-containing solutions of diethanolamine, N-methyldiethanolamine, diisopropanolamine, and mixtures of these including mixtures with sulfolane and other gas conditioning solvents, also aqueous potassium carbonate are all protected by these inhibitor combinations.

We claim:

1. A sour gas conditioning solution inhibited against $CO_2$ promoted corrosion of iron and steel by having dissolved therein an inhibiting concentration of a combination of one part by weight of a quaternary pyridinium salt and about 0.001–10 parts of a thio compound which is a water-soluble thiocyanate or an organic thioamide, and, in addition to the above, a small but effective amount of cobalt, said cobalt present as a dissolved divalent cobalt compound.

2. The inhibited solution of claim 1 wherein the cobalt is present in a concentration of about 5–500 parts per million based on the weight of the solution.

3. The inhibited solution of claim 1 wherein the pyridinium salt has the formula:

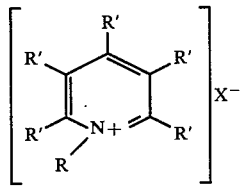

wherein R is an alkyl radical of 1–20 carbon atoms, a benzyl radical, or an alkylated benzyl radical wherein the aromatic ring has one or more alkyl substituents totaling 1–20 carbon atoms, each R′ is a hydrogen atom or an alkyl radical of 1–6 carbon atoms, and X is an anionic radical and the organic thioamide is thiourea, a polythiourea, a hydrocarbon substituted derivative thereof, or a thioamide having the formula:

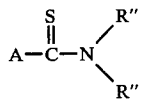

wherein A is a hydrocarbon radical of 1–12 carbon atoms or a pyridyl radical and each R″ is a hydrogen atom or an alkyl radical of 1–8 carbon atoms.

4. The inhibited solution of claim 3 wherein R in the pyridinium salt formula is an alkyl radical of 10–18 carbon atoms.

5. The inhibited solution of claim 4 wherein the pyridinium salt is tetradecyl polyalkylpyridinium bromide and the thio compound is thiourea.

6. The inhibited solution of claim 1 wherein the sour gas conditioning solution is a solution of a lower alkanolamine, sulfolane, potassium carbonate, or mixture thereof in water, glycol, or a water-glycol mixture.

7. The inhibited solution of claim 6 wherein the solution is an aqueous lower alkanolamine.

8. The inhibited solution of claim 7 wherein the alkanolamine is ethanolamine.

9. The inhibited solution of claim 1 wherein the concentration of the total inhibitor combination is at least about 55 parts per million by weight.

10. The inhibited solution of claim 1 wherein the cobalt concentration is about 10–50 ppm.

* * * * *